US009004173B2

(12) United States Patent
Richard et al.

(10) Patent No.: US 9,004,173 B2
(45) Date of Patent: Apr. 14, 2015

(54) CEMENT WIPER PLUG WITH SIZE CHANGING FEATURE

(75) Inventors: Bennett M. Richard, Houston, TX (US); Oleg A. Mazyar, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 783 days.

(21) Appl. No.: 13/104,460

(22) Filed: May 10, 2011

(65) Prior Publication Data

US 2012/0285696 A1 Nov. 15, 2012

(51) Int. Cl.

| | |
|---|---|
| ***E21B 33/08*** | (2006.01) |
| ***E21B 36/00*** | (2006.01) |
| ***E21B 33/16*** | (2006.01) |
| ***E21B 37/04*** | (2006.01) |

(52) U.S. Cl.

CPC ..... *E21B 36/00* (2013.01); *E21B 33/08* (2013.01); *E21B 33/16* (2013.01); *E21B 37/04* (2013.01)

(58) Field of Classification Search

CPC ..... E21B 37/10; E21B 33/08

USPC ..... 166/177.3, 311; 15/104.05, 104.061, 15/104.062, 104.063

See application file for complete search history.

(56) References Cited

U.S. PATENT DOCUMENTS

| | | | | |
|---|---|---|---|---|
| 3,875,606 | A * | 4/1975 | Landers | 15/104.061 |
| 5,435,386 | A | 7/1995 | LaFleur | |
| 6,595,282 | B2 * | 7/2003 | Smith, Jr. | 166/177.3 |
| 7,096,949 | B2 | 8/2006 | Weber et al. | |
| 7,392,852 | B2 * | 7/2008 | Richard | 166/387 |
| 7,673,688 | B1 | 3/2010 | Jones et al. | |
| 8,276,670 | B2 * | 10/2012 | Patel | 166/317 |
| 2007/0240877 | A1 * | 10/2007 | O'Malley et al. | 166/179 |
| 2008/0190613 | A1 | 8/2008 | Tjorswaag et al. | |
| 2010/0038086 | A1 | 2/2010 | Bunnell et al. | |

OTHER PUBLICATIONS

Halliburton Brochure; Foam Wiping Technology, 2009, 4 pages.

* cited by examiner

*Primary Examiner* — David Andrews
(74) *Attorney, Agent, or Firm* — Steve Rosenblatt

(57) ABSTRACT

Wiper plugs or other shapes are made from shape memory foam in a size large enough to wipe or clean a tubular of a predetermined size. The plug or other shape is then reformed to a smaller dimension above its transition temperature and allowed to cool while holding that shape. The smaller shape allows delivery through a running string that is smaller than the tubular string to be wiped. Preferably before reaching the string to be wiped, the trigger is applied to get the wiper or other shape above its transition temperature where it then reverts to the prior larger dimension for effective wiping of the string that it will next pass through. The trigger can be well fluid temperature or composition, applied heat from the tubular, generated heat within the wiper or other shape, or heat released from agents introduced into the well acting alone or in conjunction with well fluids.

24 Claims, 6 Drawing Sheets

CEMENT WIPER PLUG WITH SIZE CHANGING FEATURE

FIELD OF THE INVENTION

The field of the invention is wiper plugs and more particularly plugs that have to be introduced through a smaller string and thereafter wipe in a larger tubular.

BACKGROUND OF THE INVENTION

Cement is used to seal tubulars in boreholes. The cement is pumped through a one way valve at the lower end of the string to be sealed that is also known as a shoe. The pumped cement needs to be displaced from the tubular to the surrounding annulus after it is delivered from the surface. Different wiper plug systems have been devised to push the cement ahead of the plug until the plug is bumped on a landing shoulder in the vicinity of the shoe.

Liner wiper plugs are typically suspended at the top of a liner to be cemented with an open passage through the wiper plug thorough which the cement is delivered. A dart is then landed in the wiper plug and the two travel together to wipe the liner free of cement until the plug is bumped. The plug can have extending fins in parallel rows or it can be a solid block. A one or two plug system can be used and in each case a dart lands in the plug to move the two in tandem. Composite materials have been employed in such plugs to speed up milling that occurs after the plug or plugs are bumped and the cement sets. The normal procedure is to drill out the plug or plugs and the shoe and either extend the well or complete the well.

Because the plug or plugs are initially located in the liner or casing to be cemented, they are already of the appropriate size for the wiping task that needs to be done when they are deployed. However, issues can develop if the wiper is to be delivered through a smaller running string for the liner or casing to be cemented and then still be expected to wipe the inside dimension of the far larger casing or liner. One approach to addressing this problem has been the development of plugs made of compressible foam that can be squeezed into the running string and pushed with pressure to the casing or liner where the expectation is for the foam to then relax and retain its initially larger dimension. While introducing the plug to the larger diameter tube will allow it to regain its former shape, the problem with such foam plugs under differential pressure loading will be that the pressure will again deform the plug by compression to open bypass flow paths around it and thus undermining its ability to serve as an effective wiper plug. The rationale for such plugs is that they can pass restrictions on the way down and in theory still function effectively as a wiper plug after traversing a limited number of obstructions and reforming. Both foam darts and balls made of open cell rubber have been offered by Halliburton with the caveat that they cannot be used in cementing service where there is a series of tight restrictions.

Various attempts have been made to design wipers regardless of shape that can go through an obstruction and then continue to operate, generally in a tubular having the same drift above and below the obstruction. Some examples of such devices can be seen in US Publication 2008/0190613; U.S. Pat. No. 7,673,688 using a foam body and an external screening material; U.S. Pat. No. 5,435,386 showing a cement plug with a rubber mandrel and a foam exterior layer; U.S. Pat. No. 7,096,949 shows a wiper plug with an articulated seal that is actuated with applied differential pressure as illustrated in FIGS. 8*a* and 8*b*. US Publication 2010/0038086 teaches the use of stimulus responsive materials that can swell or get smaller in a production system to regulate the location of the produced flow into the wellbore using the stimuli that make plugs change dimension.

The present invention seeks to provide a plug that can be delivered in a smaller string to wipe effectively in a larger string. This is accomplished with shape memory foam that is brought past its transition temperature downhole so that it can pass through a running string and then revert to a larger original shape for effective wiping of the string being cemented or undergoing other downhole operations. The stimulus can be using well fluids or applied heat or reactive materials that are held apart for run in and then allowed to contact for an exothermic reaction that triggers the wiper to revert to the larger size suitable for wiping the larger tubular. Those skilled in the art will more fully appreciate the various aspects of the invention from a review of the description of the preferred embodiment and the associated drawings while appreciating that the full scope of the invention is to be determined by the appended claims.

SUMMARY OF THE INVENTION

Wiper plugs or other shapes are made from shape memory foam in a size large enough to wipe or clean a tubular of a predetermined size. The plug or other shape is then reformed to a smaller dimension above its transition temperature and allowed to cool while holding that shape. The smaller shape allows delivery through a running string that is smaller than the tubular string to be wiped. Upon reaching the string to be wiped, the trigger is applied to get the wiper or other shape above its transition temperature where it then reverts to the prior larger dimension for effective wiping of the string that it will next pass through. The trigger can be well fluid temperature or composition, applied heat from the tubular, generated heat within the wiper or other shape, or heat released from agents introduced into the well acting alone or in conjunction with well fluids.

DETAILED DESCRIPTION OF THE PREFERRED EMBODIMENT

Figure 1:
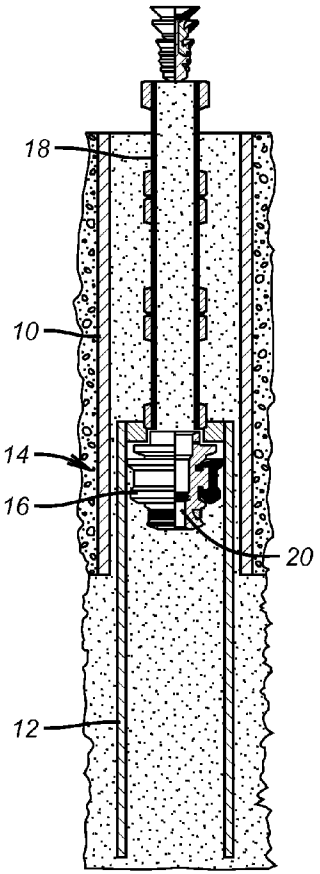
(PRIOR ART) FIG. 1
FIGS. 1-5 are a sequence of views showing the use of a cement wiper plug in the string to be cemented and launched with a dart that lands in the wiper after the cement has passed.
Figure 2:
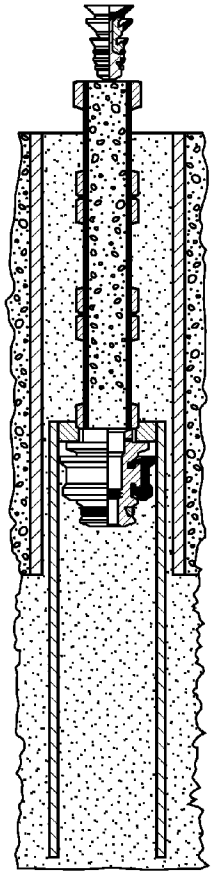
(PRIOR ART) FIG. 2
Figure 3:
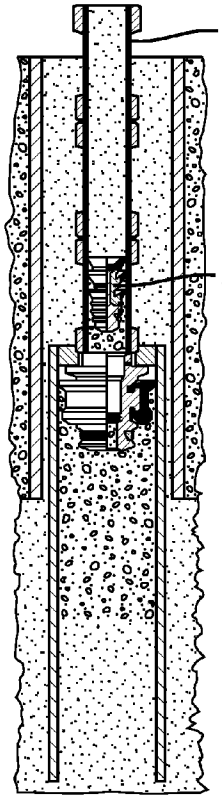
(PRIOR ART) FIG. 3
Figure 4:
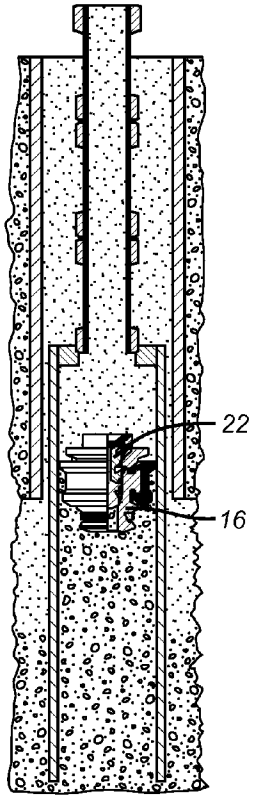
(PRIOR ART) FIG. 4
Figure 5:
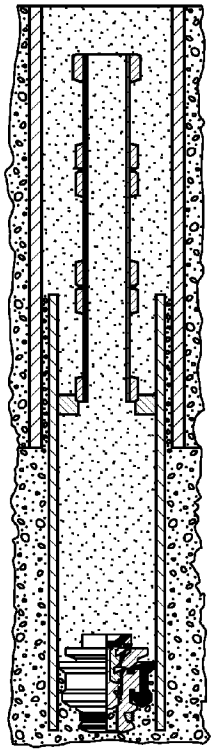
(PRIOR ART) FIG. 5
Figure 6:
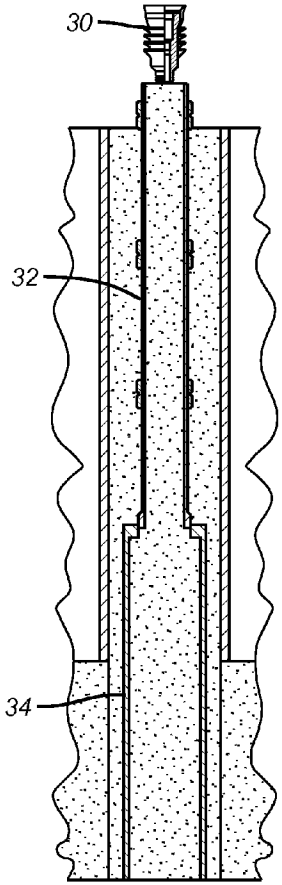
FIGS. 6-10 show the present invention with a wiper passing through a running string and then triggered to a larger dimension for wiping cement out of a larger string being sealed with cement.
Figure 7:
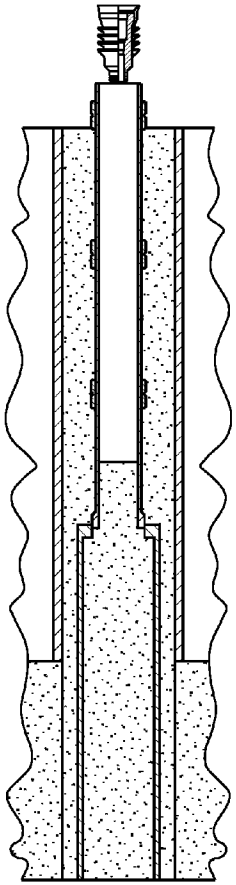
Figure 8:
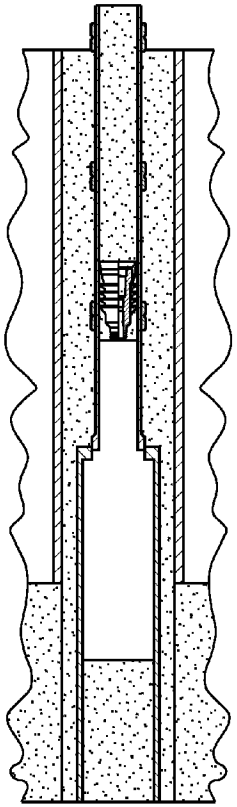
Figure 9:
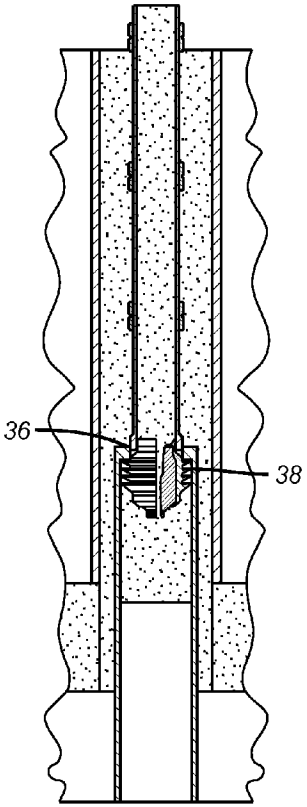

In order to provide some perspective for the invention, FIGS. 1-5 will be initially reviewed to illustrate a currently used technique for wiping a string after cement is delivered through a passage in the wiper that is then closed after cement delivery with a dart to allow differential pressure to launch the assembly and wipe the cement from the tubular. In FIG. 1 an existing cemented casing 10 has a liner 12 run through it and supported in an overlapping manner. Generally a liner hanger (not shown) is placed in the lap area 14 for support and for sealing between the two tubulars. The wiper plug 16 is sized for tubular 12 and is delivered with tubular 12 on running string 18. For run in the wiper 16 has an open passage 20 through which the cement will pass as shown in FIG. 3. A smaller wiper 22 sized for the running string 18 passes the running string 18 and lands on wiper 16. Together, the wipers 16 and 22 travel down the tubular 12 to wipe it free of cement as illustrated in FIGS. 4 and 5. It should be noted that each wiper is sized for the tubular through which it is expected to wipe. To accomplish this the wiper 16 is run in with the string 12 and the dart or wiper 22 passes only through the running string 18 before landing in wiper 16.

Figure 10:
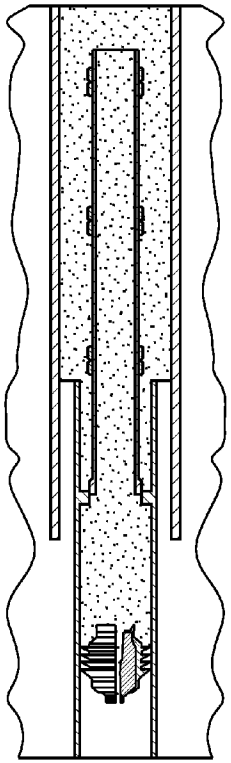
Figure 11:
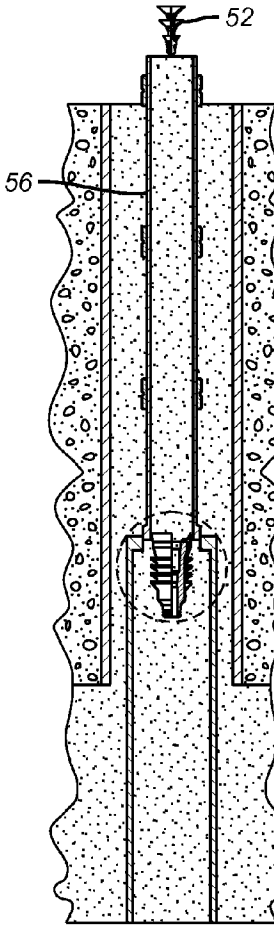
FIGS. 11-14 show the triggering of the dimensional change with a dart that penetrates a membrane to allow an exothermic reaction to create the heat to change the wiper dimensions for wiping the larger tubular.
Figure 12:
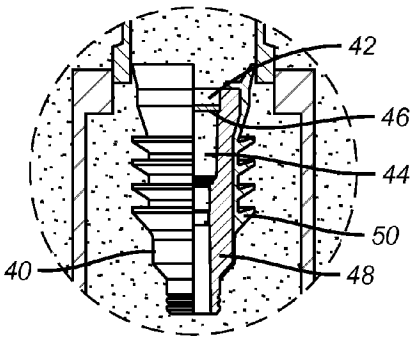
Figure 13:
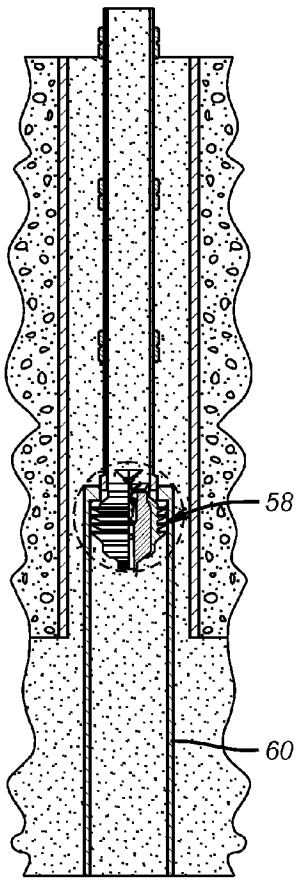

FIGS. 6-10 schematically illustrate the present invention. A single plug 30 passes through the running string 32 and then into the larger tubular 34. As the plug 30 progresses it pushes out the cement from the running string 32 and at the transition 36 the plug is subjected to sufficient heat to get it above its transition temperature so that the shape memory foam core of the plug 30 swells to raise the outside diameter of the outer fin assembly 38 as seen in comparing FIG. 8 with FIG. 9. In FIG. 10 the now enlarged wiper 30 wipes the cement clear from the tubular 34.

Figure 14:
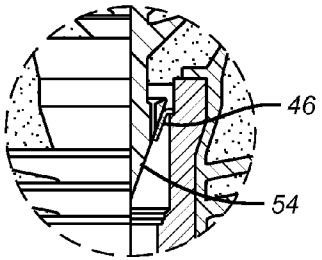

FIGS. 11-14 illustrate one way this size change takes place. Wiper plug 40 has chambers 42 and 44 separated by a wall 46. The core 48 that defines these chambers is preferably made of shape memory foam and is surrounded by the fin assembly 50 that is generally made from an elastomer although other materials durable enough to wipe cement without tearing apart can also be used. The fin assembly 50 grows with the core 48 as heat is applied to the core 48. The heat is generated from a reaction of components that are in chambers 42 and 44 when the wall 46 is undermined by the landing of a dart 52. FIG. 14 shows the dart 52 having a point 54 that penetrated the wall 46 to allow two materials that react exothermically to mix and generate heat. Thus a single wiper 40 goes through the running string 56 to get to the lap region 58 with tubular 60. At that location its dimension is increased with the heat of reaction and it assumes a dimension large enough to wipe the tubular 60. Generating the heat with a triggered reaction is but one way that heat is applied to get a wiper past the transition temperature so that it can revert to an originally larger dimension for wiping the larger sized tubular below. There are other ways.

Figure 15:
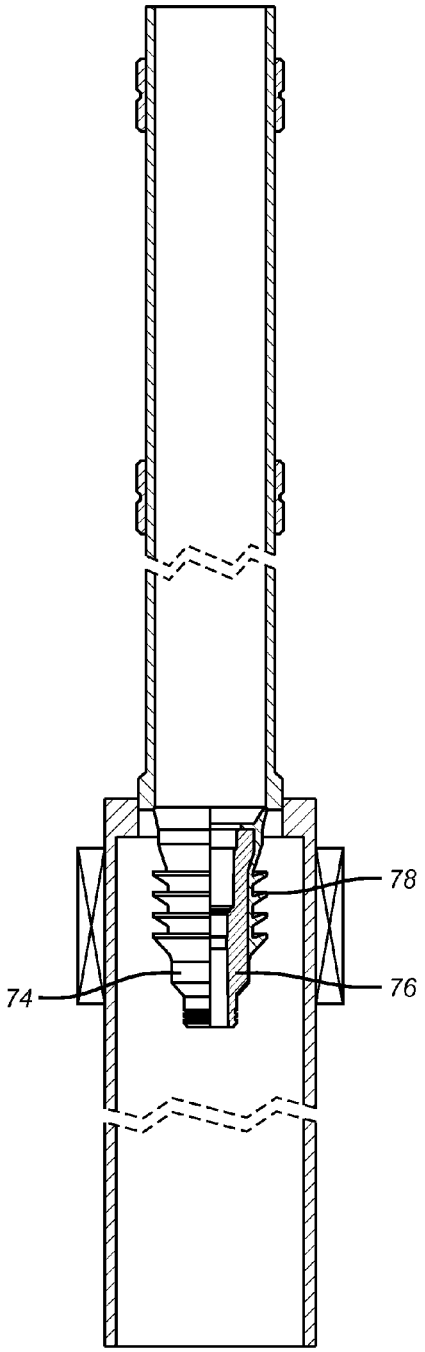
FIGS. 15-16 show a way that heat is applied before or after the wiper passes the running string to enlarge it for wiping a larger tubular that is cemented below.
Figure 16:
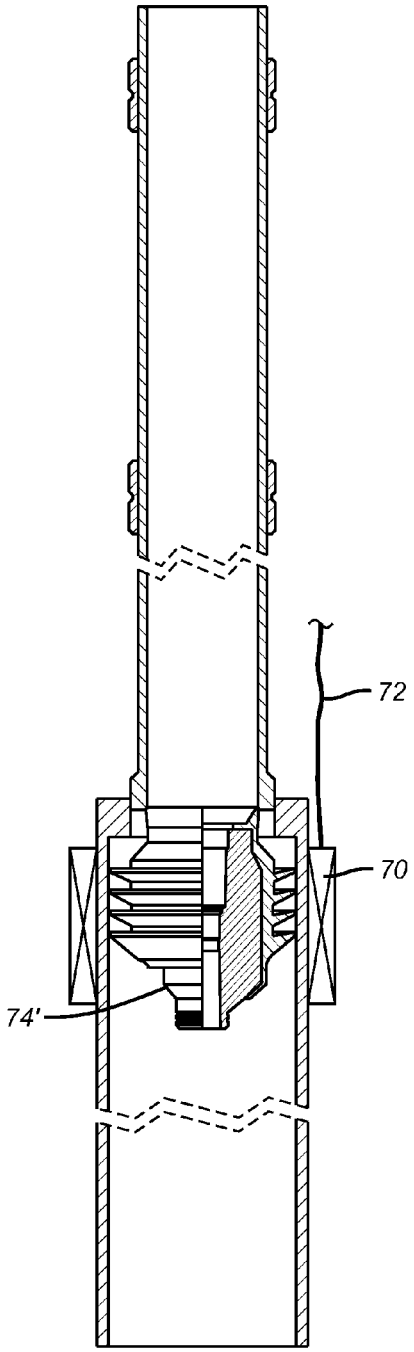

One other way is illustrated in FIGS. 15 and 16 in a schematic way. A heater 70 powered from the surface or locally as schematically represented by a line 72 can be used to apply heat to the plug 74 to allow its core to grow to a larger dimension as shown in FIG. 16 with the enlarged plug 74'. What has happened is that the core 76 has grown radially and has taken the outer fin assembly 78 radially outwardly with it. Heat can also be added in other ways such as the temperature of the well fluids themselves or the pumping down of fluids into the wellbore that cause a reaction that generates heat. The wiper body itself can contain a power source such as a battery and a processor to trigger activation of a heater at a certain time or at a predetermined depth to get the wiper to revert to the larger dimension for wiping the larger tubular. Heat can be applied while still in the smaller string or it can be applied after or in the transition to the larger string. The plug 74 needs to have attained its larger dimension before it is needed to wipe the larger tubular.

While shape memory foam is preferred, other core materials that can change shape with a proper stimulus signal are also envisioned. Shape memory alloy or polymer cores are also contemplated. As another alternative the plug or parts thereof can be made of a swelling material that responds to well fluids that contain hydrocarbons or water to initiate the swelling so as to enlarge the plug for wiping the larger tubular. Elastomers such as rubber can be used. The core and fin structure can be a common material or different materials. The core can be shape memory foam surrounded by a swelling material that is responsive to water or oil based fluids. On the other hand the entire plug can be of a uniform material internally and externally.

Figure 17:
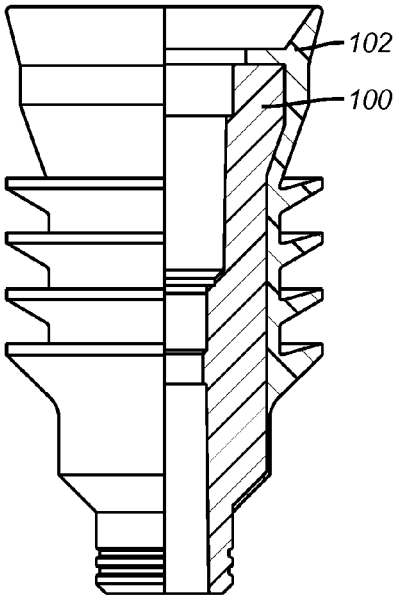
FIGS. 17-23 show different wiper embodiments that are capable of dimensional change to wipe a larger string after passing through a narrower one.
Figure 18:
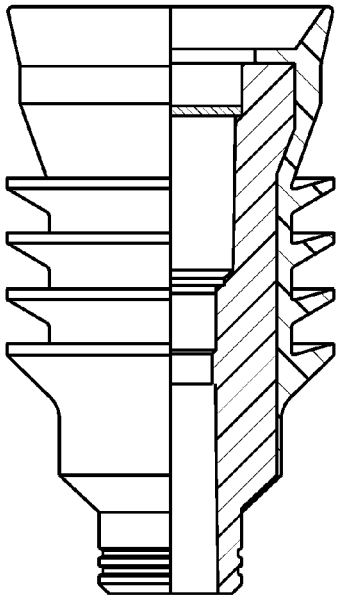
Figure 19:
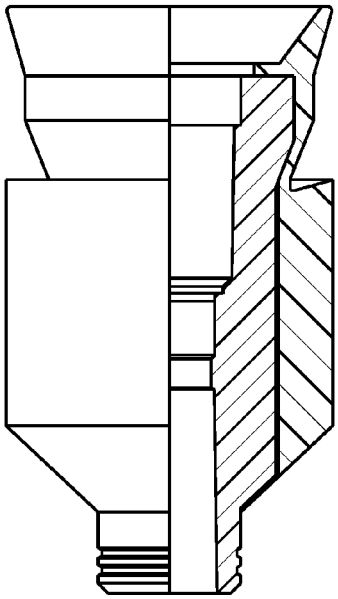
Figure 20:
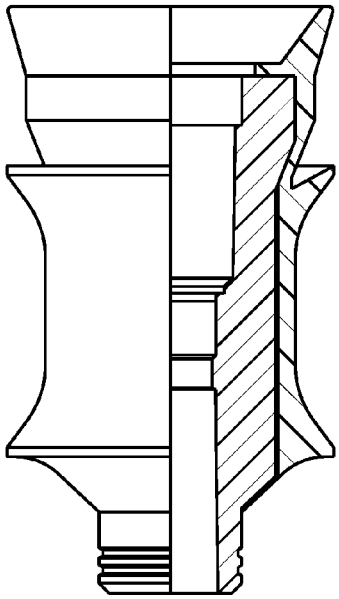
Figure 21:
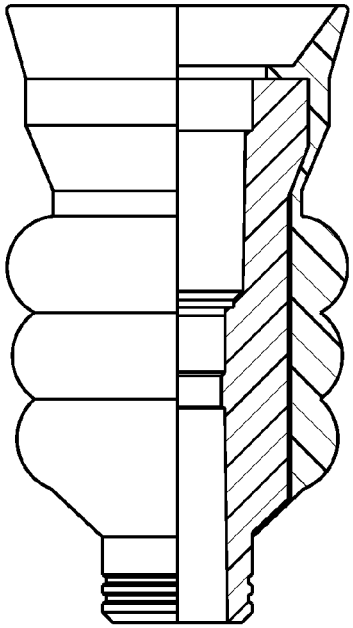
Figure 22:
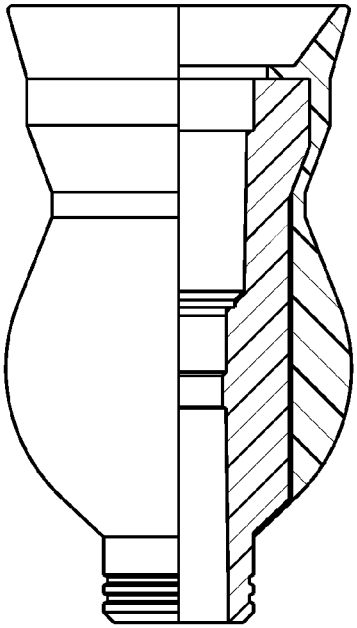
Figure 23:
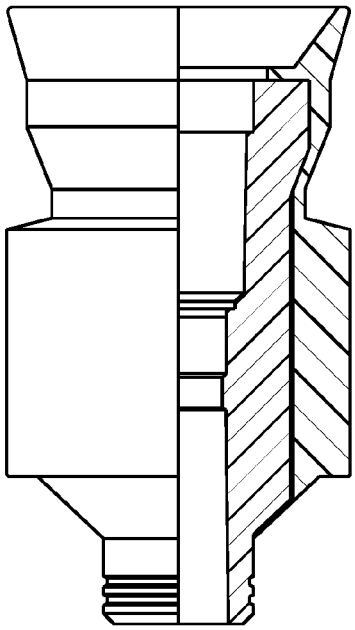

FIGS. 17-23 illustrate a series of plugs that have a common core 100 with different exterior wiper assemblies 102. Preferably the cores 100 are shape memory foam that can support differing wiper assemblies 102. There can be rounded bumps as in FIG. 21 or a single arcuate shape as in FIG. 22. There can be opposed points that are spaced apart as in FIG. 20 or generally cylindrical shapes that in cross-section are either rectangular as in FIG. 23 or a parallelogram as in FIG. 19. The traditional parallel extending fin design is illustrated in FIGS. 17 and 18 and the wiper assembly can also be of the same or a different material than the core material of the cores 100. Both can be shape memory foam for example or the wiper assembly can be a flexible elastomer for example. The core 100 can alternatively be a shape memory alloy or polymer. The wiper assembly 102 can also have weaker segments that reduce the resistance of the wiper assembly 102 to growth of the core 100 when the temperature stimulus is applied.

The above description is illustrative of the preferred embodiment and many modifications may be made by those skilled in the art without departing from the invention whose scope is to be determined from the literal and equivalent scope of the claims below.

We claim:

1. A wiper apparatus for subterranean location use to travel through a first and second tubulars that have different dimensions with the second tubular being larger than the dimension of the first tubular, comprising:

a structural core having a passage and responsive to a stimulus initiated by an object entering said passage, while keeping said passage closed to allow the wiper apparatus to be moved with applied pressure, to increase from a first dimension, to a second dimension;

an outer assembly that increases from a first dimension smaller than said second tubular to a second dimension to extend to the wall of the second tubular to wipe the second tubular.

2. The apparatus of claim 1, wherein:

said core is made of shape memory foam.

3. The apparatus of claim 1, wherein:

Said core is made from a shape memory alloy or a shape memory polymer.

4. The apparatus of claim 1, wherein:

said stimulus comprises heat.

5. The apparatus of claim 4, wherein:

said heat is produced from within said core.

6. The apparatus of claim 5, wherein:

said core comprises spaced chambers separated by a wall with reactive ingredients positioned in selective isolation from each other until said wall is compromised.

7. The apparatus of claim 6, wherein:

said reactive ingredients react exothermically when mixed.

8. The apparatus of claim 6, wherein:

said wall is broken by said object that lands in said core.

9. The apparatus of claim 1, wherein:

said outer dimension increase occurs when said core is located in the second tubular.

10. The apparatus of claim 1, wherein:

said core dimensional increase is due at least in part to heat provided by a heater, well fluid temperature, or materials added to the subterranean location to create localized heating of said core.

11. The apparatus of claim 1, wherein:

said outer assembly has weak segments to reduce resistance to growth of said core when the stimulus is applied.

12. The apparatus of claim 1, wherein:

said outer assembly comprises parallel fins, one arcuate projection, a series of arcuate projections, spaced apart extending pointed ends, or a generally cylindrical outer shape that is rectangular or a parallelogram shape in section.

13. The apparatus of claim 1, wherein:

at least one of said core and said outer assembly swells in the presence of hydrocarbons or water.

14. A method of wiping a tubular clear of cement, comprising:

running a single wiper assembly through a running string and then through said tubular to be wiped, said running string having a smaller dimension than said tubular;

removing material from said tubular to be wiped with said single wiper assembly;

providing a structural core having a passage to receive a solid object for creation of a stimulus for said core of said assembly to change shape by breaking a barrier in said passage between reactants stored in said core that react exothermically.

15. The method of claim 14, comprising:

changing said shape with a stimulus applied before or after said assembly passes said running string.

16. The method of claim 15, comprising:

using heat as said stimulus.

17. The method of claim 16, comprising:

using shape memory foam for said core of said wiper assembly.

18. The method of claim 17, comprising:

generating said heat from within said core.

19. The method of claim 16, further comprising:

additionally getting said heat from a heater, or from well fluids or from fluids added to well fluids.

20. The method of claim 16, comprising:

providing an outer assembly around said core that grows to contact the tubular to be wiped where said outer assembly is made from the same or a different material than said core.

21. The method of claim 20, comprising:

providing weak spots in said outer assembly to reduce resistance to growth of said core.

22. The method of claim 20, comprising:

providing for said outer assembly parallel fins, one arcuate projection, a series of arcuate projections, spaced apart extending pointed ends, or a generally cylindrical outer shape that is rectangular or a parallelogram shape in section.

23. The method of claim 20, comprising:

making said core from a shape memory alloy or polymer and said outer assembly from an elastomer.

24. The method of claim 15, comprising:

making at least a portion of said wiper assembly from a material that swells in the presence of hydrocarbons or water.

* * * * *